US010070743B2

(12) United States Patent
Sladics

(10) Patent No.: US 10,070,743 B2
(45) Date of Patent: Sep. 11, 2018

(54) REUSABLE GROMMET WITH STRAW INSERTION FEATURE

(71) Applicant: Cyndi W Sladics, Newport Beach, CA (US)

(72) Inventor: Cyndi W Sladics, Newport Beach, CA (US)

(73) Assignee: Simply Straws, Costa Mesa, CA (US)

( * ) Notice: Subject to any disclaimer, the term of this patent is extended or adjusted under 35 U.S.C. 154(b) by 124 days.

(21) Appl. No.: 15/062,188

(22) Filed: Mar. 6, 2016

(65) Prior Publication Data

US 2016/0286992 A1 Oct. 6, 2016

Related U.S. Application Data

(60) Provisional application No. 62/129,019, filed on Mar. 5, 2015.

(51) Int. Cl.
*A47G 19/22* (2006.01)

(52) U.S. Cl.
CPC ..... *A47G 19/2222* (2013.01)

(58) Field of Classification Search
CPC ..... A47G 19/2222
USPC ..... 220/709, 705; 16/2.1, 2.2, 2.3
See application file for complete search history.

(56) References Cited

U.S. PATENT DOCUMENTS

| | | | | |
|---|---|---|---|---|
| 7,582,836 | B2 * | 9/2009 | Tapper | H02G 3/083 16/2.1 |
| 7,721,911 | B2 * | 5/2010 | Chou | B65D 43/0202 215/310 |
| 8,739,363 | B2 * | 6/2014 | Allen | A61B 50/20 16/2.1 |
| 2006/0102628 | A1 * | 5/2006 | Hage | A01K 1/031 220/254.6 |

* cited by examiner

*Primary Examiner* — Stephen Castellano
(74) *Attorney, Agent, or Firm* — Marin Patents, LP; Gustavo Marin

(57) ABSTRACT

A grommet of resilient material having a top and bottom circumferential surfaces, wherein the body defining a central passage therethrough and defining a plurality of flanges forming an integral part of the grommet and extending inwardly from the body. The body further comprising an external holding groove extending longitudinally from the rear toward the front and extending completely around the outer periphery thereof to engage edges of the circular aperture of a beverage container. The flanges, when not engaged, forming a closed barrier across the grommet to frictionally create a hermetic seal against the passage of heat, moisture, and vapor therethrough. The flanges, when engaged, bending in a downwardly extending position against the outer surface of a straw and frictionally forming a hermetic seal between the flange and the straw.

4 Claims, 5 Drawing Sheets

REUSABLE GROMMET WITH STRAW INSERTION FEATURE

CROSS-REFERENCE TO RELATED APPLICATIONS

This application claims the benefit of, and priority to, U.S. provisional patent application 62/129,019 titled, "REUSABLE GROMMET WITH STRAW INSERTION FEATURE", filed on Mar. 5, 2015, the entire specification of which is incorporated herein by reference.

BACKGROUND OF THE INVENTION

Field of the Art

The disclosure relates generally to methods of environmental preservation and saving of natural resources. More particularly, the invention relates to a reusable silicone grommet with straw insertion feature that provides a novel and improved sealing arrangement by producing a means for inserting a straw while eliminating waste associated with single use beverage containers.

Discussion of the State of the Art

The Mason™ jar was invented and patented in 1858 by Philadelphia tinsmith John Landis Mason™. Among other common names for them are Ball jars, after Ball Corporation, an early and prolific manufacturer of the jars; fruit jars for a common content; and simply glass canning jars reflecting their material. Though a typical use of the Mason™ jar is home canning and for the preservation of food, given the durability, ease of replacement, and good looks, the Mason™ jar has become a trend, specifically among environmentalists, to use as a beverage container.

The mouth of the jar has screw threads on its outer perimeter to accept a metal ring (or "band"). The band, when screwed down, presses a separate stamped steel disc-shaped lid against the rim of the jar. An integral rubber ring on the underside of the lid creates a hermetic seal to the jar. The bands and lids usually come with new jars, and bands and lids are typically sold separately; while the bands are reusable, the lids are intended for single use when canning.

In recent times, it has become common to alter the Mason™ jar lids to accept a straw, for example by drilling a hole to accept a straw into the liquid. However, these typical do-it-yourself methods do not create a reliable means for portability or for the prevention of spillage and can often damage straws.

What is needed is a means to promote reusability by making the Mason jar and other like containers a viable portable beverage container that effectively prevents the spillage of its contents.

SUMMARY OF THE INVENTION

A reusable silicone discoid grommet or closure member for sealing an open-ended beverage container such as a Mason™ jar is disclosed. The grommet includes a top having a first center and a bottom having a second center. The second center being in the same axis as the first center. This axis being a certain thickness.

In a first embodiment, to facilitate sealing the beverage container, the silicone grommet is placed within a Mason™ jar band replacing a typical separate stamped steel disc-shaped lid. A grooved peripheral edge portion member on the outer circumferential perimeter of the silicone grommet accepts the edge portion of the Mason™ jar by creating a hermetic seal to prevent the passage of liquid or air. An edge portion member on the underside of the silicon lid creates a hermetic seal to the jar against the rim of the jar on an open-ended side of an open-ended container when the band is screwed onto the mouth of the jar to the screw threads on the outer perimeter of the jar. Given the high-friction coefficient of silicone, the hermetic seal is reliable for the purpose of storing liquids while providing an effective portable means to carry liquid.

In a second embodiment, to facilitate sealing the beverage container, the silicone grommet is placed within a Mason™ jar disc-shaped lid thereby leveraging the sealing mechanism of the Mason™ jar lid. A grooved peripheral edge portion member on the outer circumferential perimeter of the silicone grommet accepts the edge portion of the Mason™ jar lid by creating a hermetic seal to prevent the passage of liquid or air. Given the high-friction coefficient of silicone, the hermetic seal is reliable for the purpose of storing liquids while providing an effective portable means to carry liquid.

The grommet is formed from pliable silicone and is able to adapt to the shape of a Mason™ jar band, a Mason™ jar lid, an open-ended container, or the like. The lid also has elastic characteristic which may allow the edge of the open-ended container, lid, or band to be depressed against the silicone material. Once the grommet is removed from the container, lid, or band, the grommet will return to its normal state.

Other features of the silicone grommet include a plurality of pliable flanges that accept the insertion of different sized straws (that is, straws of a different diameters), for example, a reusable glass straw such as Simply Straws™, through the grommet into contact with the contents of the container. In some embodiments, the straw may be positioned at various angles based on user preference. The flanges are resiliently firm yet soft enough to give way to accept a straw and seal around the straw to integrate a hermetic seal when a straw is present. The flanges are resiliently firm enough to hold their shape and return to their normal state when no straw is inserted thereby integrating a hermetic seal when no straw is present, thus providing an effective means of container portability while eliminating the requirement of an additional lid.

The silicone grommet comes in a plurality of sizes and can fit most standard Mason™ jars, Mason™ jar bands, be integrated into existing lids, and be inserted into other containers.

It can be appreciated by one with ordinary skill in the art, that features of the silicone grommet integrated within a lid, provide improvements over systems known in the art of (1) keeping the contents of container fresh by preventing the passage of air into the container; (2) keeping the temperature of the contents of container stable due to temperature resistant characteristics of silicone; and, (3) the lid may also microwave-safe and dishwasher-friendly for hygienic purposes.

BRIEF DESCRIPTION OF THE DRAWING FIGURES

The accompanying drawings illustrate several embodiments of the invention and, together with the description, serve to explain the principles of the invention according to the embodiments. It will be appreciated by one skilled in the art that the particular embodiments illustrated in the drawings are merely exemplary, and are not to be considered as limiting of the scope of the invention or the claims herein in any way.

DETAILED DESCRIPTION

The inventor has conceived, and reduced to practice, a reusable beverage container lid grommet.

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way. One or more embodiments of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and that structural and other changes may be made without departing from the scope of the particular embodiment of the invention. Accordingly, one skilled in the art will recognize that one or more of the embodiments of the invention may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

Figure 1:
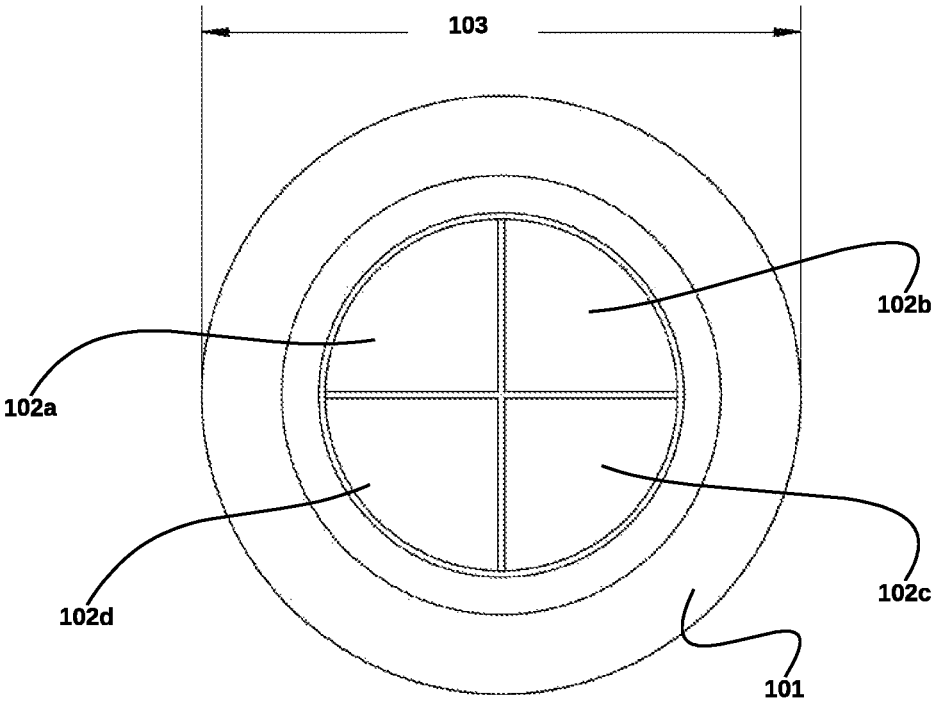
FIG. 1 is a top view of a reusable beverage container grommet showing a straw insertion feature.
Figure 2:
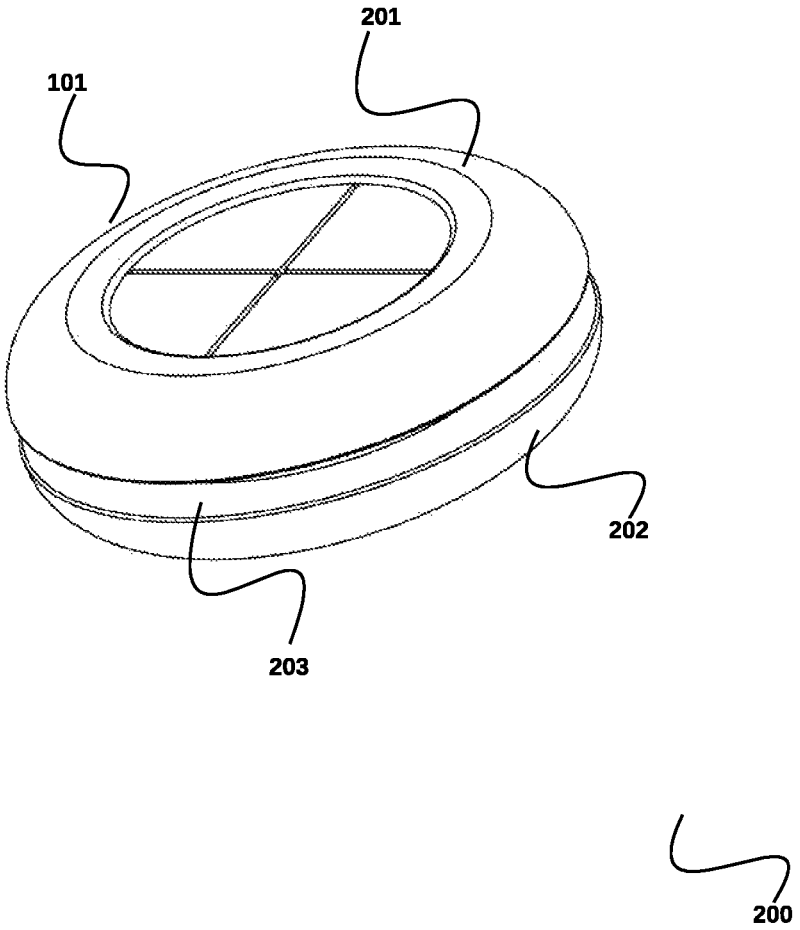
FIG. 2 is an angular view of a reusable beverage container grommet showing a mounting groove.

FIG. 1 is a top view of a reusable beverage container grommet showing a straw insertion feature. According to the embodiment grommet 101 includes top 201 (as shown in FIG. 2) having a first center and bottom 202 having a second center. The second center being in the same axis as the first center. Grommet 101 comprises a homogeneous rubber-like elastomeric material such as a synthetic material that may be polymers with a chemical structure based on chains of alternate silicon and oxygen atoms, with organic groups attached to the silicon atoms (for example, silicone). Such compounds are typically resistant to chemical attack and insensitive to temperature changes thus minimizing heat (or cold) dissipation. Grommet 101 prevents contact between a straw and the inner edge of a lid to prevent, for example, scraping against a metal or abrasive edge. Otherwise, in this regard, the metal could damage the straw. According to the embodiment, grommet 101 having an aperture therethrough comprises a plurality of adjacent triangular pliable flanges 102*a*, 102*b*, 102*c*, and 102*d* to accept and separate when a straw is engaged through grommet 101 into contact with the contents of the container. It should be noted that grommet 101 may accept different sized straws (that is, straws of a different diameters), for example, a reusable glass straw such as Simply Straws™ or stainless steel straws or regular disposable plastic straws. In some embodiments, the straw may be positioned at various angles based on user preference. Flanges 102*a*, 102*b*, 102*c*, and 102*d* are firm yet soft enough to give way to accept the straw and to provide friction to form a hermetic seal around the straw when a straw is engaged. Flanges 102*a*, 102*b*, 102*c*, an 102*d* are resilient enough to hold their shape and return to their normal state when no straw is engaged, each flange providing friction against the adjacent other flange to integrate a frictionally hermetic seal when no straw is engaged, thus providing an effective means of container portability while eliminating the requirement of an additional lid. In a preferred embodiment, grommet 101 may have diameter 103 of 22 mm to 28 mm with a preferred diameter of 22.2 mm. In some embodiment diameter 103 grommet 101 may be much larger encompassing the full width of, for example, the Mason™ jar ring wherein grommet 101 is not attached to the lid, but rather the ring itself.

In some embodiments grommet 101 may comprise a different number of flanges for example, three flanges in the shape of an olive branch, peace symbol, or a three-pointed star shape enclosed in an annular orbit defining the grommet, or for example, two flanges in a semi-circular arrangement.

FIG. 2 is an angular view of a reusable beverage container grommet showing a mounting groove. In a preferred embodiment, grommet 101 may provide an internal, cylindrical mounting groove 203 near its outer periphery that permits grommet 101 to be mounted securely into an aperture of a beverage container, for example, an aperture in the container's lid, for example, on a metal lid such as a Mason™ jar lid. In a preferred embodiment, the diameter of the aperture of the container lid is the same as the diameter of mounting groove 203. Since the diameter of grommet 101 is larger than the diameter of the mounting groove, as grommet 101 is forcibly inserted into the aperture of the lid, after being inserted, grommet 101 spring back to its original shape and is thus firmly held in the container aperture by mounting groove 203 around the outer periphery of grommet 101. It should be appreciated by one with ordinary skill in the art that any lid may be used to mount grommet 101 by inserting it forcefully into an appropriately sized receiving hole. In some embodiments, a mounting groove is not present. In this regard, a canonical shape for grommet 101 may be used in order to employ friction to attach grommet 101 to the aperture of the beverage lid so that is remains resiliently engaged.

Figure 3:
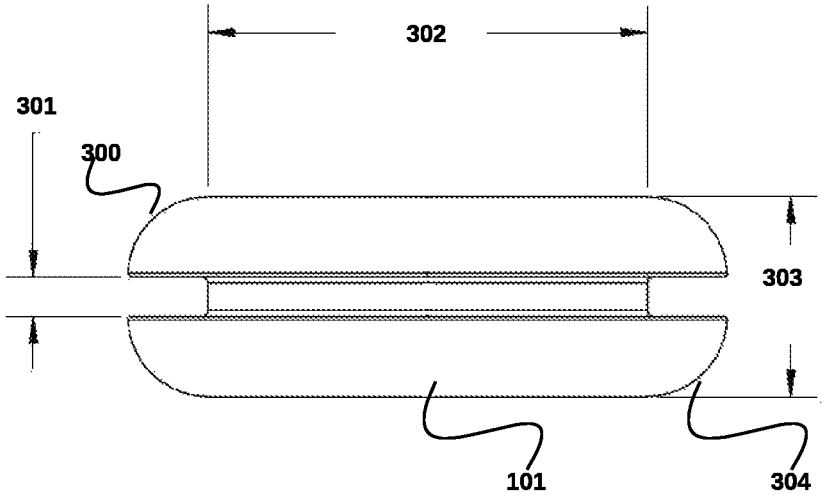
FIG. 3 is a side view of a reusable beverage container grommet showing a mounting groove.
Figure 3:
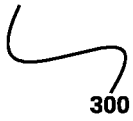

FIG. 3 is a side view of a reusable beverage container grommet showing a mounting groove. In a preferred embodiment, grommet 101 comprises circumferential mounting groove 203 with height 301 of 1 mm to 2 mm with a preferred height of 1.5 mm. Mounting groove 203 may have diameter 302 of 17 mm to 23 mm with a preferred diameter of 17.5 mm. It can be appreciated that by having the aperture of a beverage container a similar diameter to diameter 302, grommet 101 may be resiliently retained within the aperture when forcibly engaged. Grommet 101 may have height 303 of 8 mm to 11 mm with a preferred height of 9.5 mm.

Figure 4:
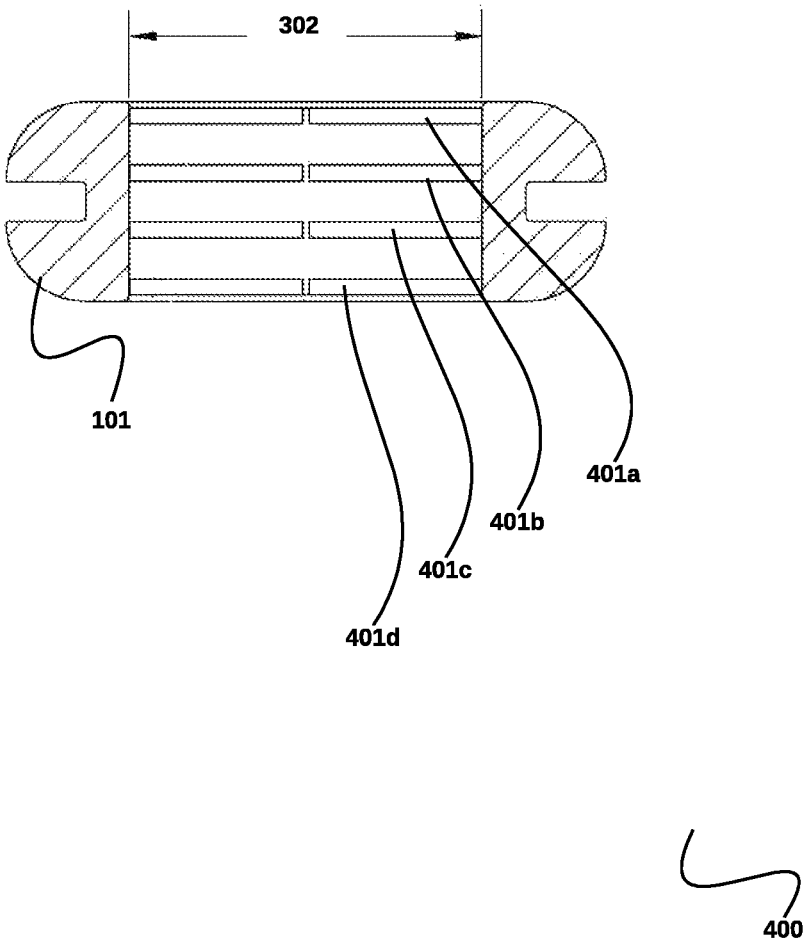
FIG. 4 is a cross section view of a reusable beverage container grommet showing a stack of parallel flanges to accommodate insertion of a straw.

FIG. 4 is a cross section view of a reusable beverage container grommet showing a stack of parallel flanges to accommodate insertion of a straw. According to the embodiment, the plurality of flanges of grommet 101 comprises a grouping of four parallel levels 401*a*, 401*b*, 401*c*, and 401*d* to create a grouping of flanges for improved heat retention and enhanced spillage prevention. In other embodiments, less than, or more than, four levels of flanges may be used.

Figure 5:
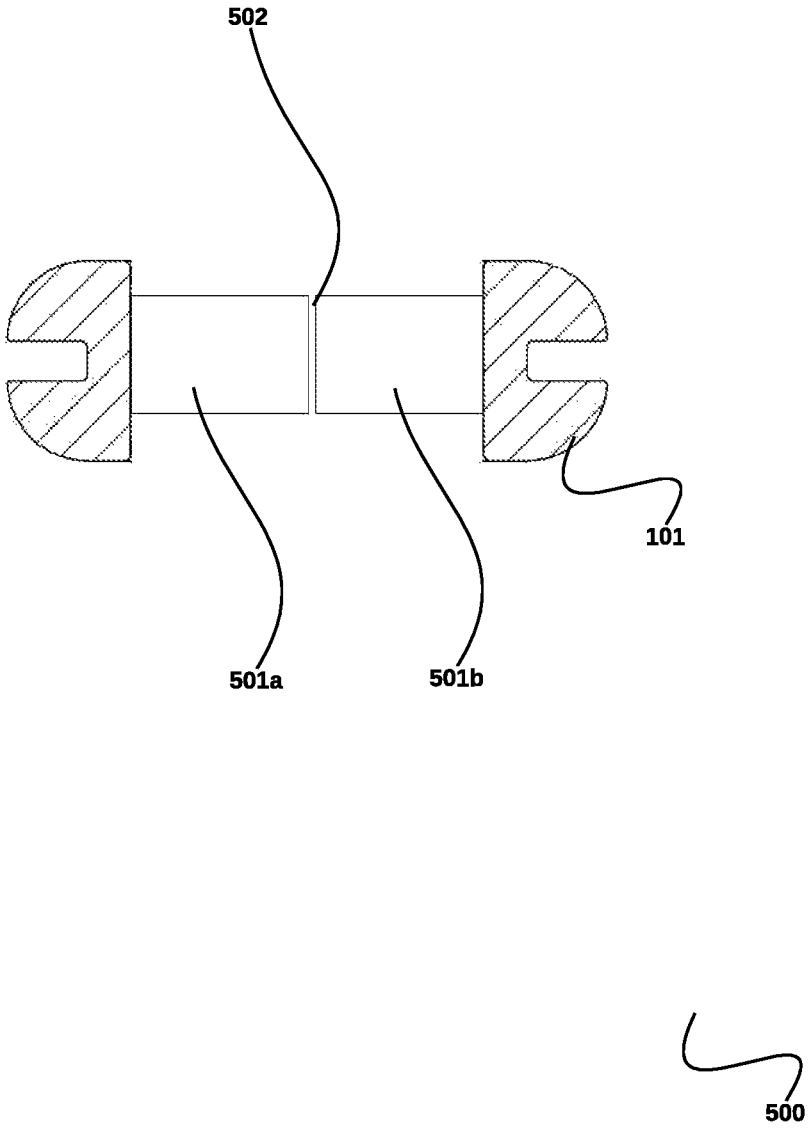
FIG. 5 is a cross section view of a reusable beverage container grommet showing a single layer of flanges to accommodate for insertion a straw.

FIG. 5 is a cross section view of a reusable beverage container grommet showing a single layer of flanges to accommodate insertion of a straw. According to the embodiment, the plurality of flanges 102*a*, 102*b*, 102*c*, and 102*d* of grommet 101 comprises a grouping of one level of flanges 501*a* and 501*b* to create a grouping of flanges for heat retention and spillage prevention. In this regard, a sectional view of grommet 101 defines a plurality of flanges 102*a*, 102*b*, 102*c*, and 102*d* in a single layer 501*a* and 501*b* forming an integral part of the grommet and extending inwardly from the body. The flanges, when not engaged, form a closed barrier across grommet 101 at meeting point 502 to frictionally form a hermetic seal for grommet 101 against the passage of heat, moisture, and vapor therethrough. Flanges 102*a*, 102*b*, 102*c*, and 102*d*, when engaged, may bend in a downwardly extending position against the outer surface of a straw and frictionally forming a hermetic seal between the plurality of flanges and the straw.

The skilled person will be aware of a range of possible modifications of the various embodiments described above. Accordingly, the present invention is defined by the claims and their equivalents.

What is claimed is:

1. A grommet for accepting a straw into a beverage container adapted to be inserted through a circular aperture in the container, the grommet comprising:

a discoid body of resilient material having a top and bottom circumferential surfaces, the body defining a central passage therethrough and defining a plurality of flanges forming an integral part of the grommet and extending inwardly from the body, the body further comprising an external, annular, holding groove extending completely around the outer periphery thereof to engage edges of the circular aperture of the container;

the plurality of flanges, when not engaged, forming a closed barrier across the grommet to frictionally form a hermetic seal to prevent the passage of heat, moisture, and vapor therethrough;

the plurality of flanges, when engaged, bending in a downwardly extending position against the outer surface of a straw to frictionally form a hermetic seal between the flange and the straw to prevent the passage of heat, moisture, and vapor therethrough;

wherein the plurality of flanges comprises four parallel layers of flanges.

2. The grommet of claim 1, wherein the body is removably mountable to the circular aperture of the container rendering the grommet reusable.

3. The grommet of claim 1, wherein the plurality of flanges comprises four substantially triangular flanges.

4. The grommet of claim 1 wherein the resilient material comprises a silicone compound.

* * * * *